US008485211B2

(12) United States Patent
Eide et al.

(10) Patent No.: US 8,485,211 B2
(45) Date of Patent: Jul. 16, 2013

(54) SUBSEA VALVE

(75) Inventors: Jørgen Eide, Fana (NO); Henrik Steine Madsen, Bergen (NO)

(73) Assignee: Framo Engineering AS, Sandsli, Bergen (NO)

( * ) Notice: Subject to any disclaimer, the term of this patent is extended or adjusted under 35 U.S.C. 154(b) by 392 days.

(21) Appl. No.: 12/676,595

(22) PCT Filed: Aug. 29, 2008

(86) PCT No.: PCT/NO2008/000304
§ 371 (c)(1),
(2), (4) Date: May 28, 2010

(87) PCT Pub. No.: WO2009/031901
PCT Pub. Date: Mar. 12, 2009

(65) Prior Publication Data

US 2010/0243069 A1 Sep. 30, 2010

(30) Foreign Application Priority Data

Sep. 7, 2007 (NO) ..... 20074534

(51) Int. Cl.
*F16K 31/12* (2006.01)

(52) U.S. Cl.
USPC ..... 137/14; 137/487.5

(58) Field of Classification Search
USPC ..... 137/236.1, 14, 487.5
See application file for complete search history.

(56) References Cited

U.S. PATENT DOCUMENTS

| | | | | |
|---|---|---|---|---|
| 3,324,875 | A | 6/1967 | Anderson | |
| 3,916,632 | A | 11/1975 | Thomas | |
| 3,933,338 | A | 1/1976 | Herd et al. | |
| 4,453,566 | A * | 6/1984 | Henderson et al. | 137/236.1 |
| 4,685,833 | A | 8/1987 | Iwamoto | |
| 4,887,643 | A * | 12/1989 | Tomlin et al. | 137/236.1 |
| 5,415,237 | A | 5/1995 | Strattan | |
| 6,651,745 | B1 | 11/2003 | Lush et al. | |
| 6,702,025 | B2 | 3/2004 | Meaders | |
| 7,108,006 | B2 | 9/2006 | Armstrong | |
| 2004/0173268 | A1 | 9/2004 | Dean | |
| 2005/0178557 | A1 | 8/2005 | Johansen et al. | |
| 2005/0178560 | A1 | 8/2005 | Johansen et al. | |
| 2007/0205383 | A1 | 9/2007 | McMiles | |

FOREIGN PATENT DOCUMENTS

| | | | |
|---|---|---|---|
| NO | 314516 | | 2/1998 |
| NO | 324777 | B1 | 11/2002 |
| NO | 318191 | | 8/2004 |
| NO | 321072 | | 8/2005 |
| NO | 322680 | B1 | 11/2006 |
| WO | WO 01/23702 | A1 | 4/2001 |
| WO | WO 2007/055589 | A1 | 5/2007 |

* cited by examiner

*Primary Examiner* — Kevin Lee
(74) *Attorney, Agent, or Firm* — Matthias Abrell

(57) ABSTRACT

The present invention regards a subsea valve system comprising a valve, a fluid supply line connectable to a remote fluid supply and in connection with an inlet of the valve, an outlet of the valve connectable to an outlet fluid line and a fluid tight housing at least partly enclosing the valve. According to the invention the fluid supply line comprises an outlet within the housing, establishing a pressure within the housing mainly equal to the pressure of the supply fluid at the inlet of the valve. The invention also regards a method for protecting a subsea valve system.

9 Claims, 2 Drawing Sheets

SUBSEA VALVE

This application is a National Stage Application of PCT/NO2008/000304, filed 29 Aug. 2008, which claims benefit of Serial No. 20074534, filed 7 Sep. 2007 in Norway and which applications are incorporated herein by reference. To the extent appropriate, a claim of priority is made to each of the above disclosed applications.

TECHNICAL FIELD

The present invention regards a subsea valve system, were one achieves an increased usability of ordinary valve in a subsea environment.

BACKGROUND

In most subsea applications electric-hydraulic valves are used to control operation of equipment such as process valves (opening and closing) and actuators. The valves are either operated with electric power supplied directly from the surface in separate electric wires, or by means of electric power in wires from a local subsea control system. The valves can be installed inside a subsea container (pod) together with the subsea control system, or some distance from the control system, normally also in a dedicated container. The main purpose of the container is to provide a benign atmosphere for the valve bodies, and the container is therefore normally filled with a fluid with electric isolation and corrosion protection, typically a hydraulic fluid or a silicone oil.

The liquid inside the container is normally maintained at the same pressure as the external ambient pressure due to the water depth. Typically, at 3.000 meter water depth the ambient pressure due to the depth is about 300 bar. The pressure inside the container is then normally maintained at approximately 300 bar as well, using pressure compensating devices. Pressure compensators are typically bladders that can expand or contract to compensate for minor changes in fluid volume inside the container due to temperature or absolute pressure changes.

As the water depth increase the external over pressure outside the valve body will increase. If the fluid that the valve is controlling needs to be kept at low pressure, the difference between the controlled fluid pressure and the ambient pressure surrounding the valve body will increase. For instance, at 5.000 meter water depth the external pressure can be about 500 bar and if the pressure of the liquid is say 100 bar then the pressure differential that the valve need to operate at is 400 bar. This high pressure differential may be a challenge for existing, qualified valves.

It is common to pressure test subsea piping systems to check the systems for leakage and a test pressure that is often used is 10.000 psi, or some 690 bar. The test pressure is applied in addition to the static pressure at depth. At very deep water the absolute pressure during pressure testing can then be very high, typically 1.000 bara at 3.000 meter water depth.

The electric-hydraulic valves are sometimes used to control a barrier fluid that is used inside equipment typically such as electric motors. The barrier fluid is kept at the test pressure plus a small margin to ensure a positive over pressure, typically 20-30 bar above the test pressure.

This means that in a case at say 3.000 meter water depth with say a test pressure of 10.000 psi the liquid that the electric-hydraulic valve shall control will be kept at 700+300+30=1.030 bar pressure on the inlet/outlet ports.

If a electric-hydraulic valve in such a case is used and installed inside a chamber where the pressure is balanced against the external water pressure at depth, the pressure differential between the external valve body and the liquid it is controlling can be very high, typically 1.030−300=730 bar. This high pressure differential may be a challenge for existing, qualified valves.

SUMMARY

An aim with the present invention is to improve the present systems or alleviate some of the problems associated with the present systems. Another aim is to provide a valve system which may be used on larger water depths with standard valves.

These aims are achieved with a valve system according to the invention as defined in the attached independent claims. Other aspects of the invention are described in the deponent claims and in the description.

According to the invention there is provided a subsea valve system comprising a valve, a fluid supply line connectable to a remote fluid supply and in connection with an inlet of the valve, an outlet of the valve connectable to an outlet fluid line. The system also comprises a fluid tight housing at least partly enclosing the valve. According to the invention the fluid supply line comprises an outlet within this fluid tight housing. By having this outlet from the fluid supply line one can establish a pressure within the housing mainly equal to the pressure of the supply fluid at the inlet of the valve. By this the valve is operated with a smaller pressure difference between the fluid within the valve and a fluid surrounding the valve.

According to one aspect the fluid tight housing may fully enclose the valve. The fluid tight housing may then be a standard fluid tight housing with openings for allowing the fluid supply line in to the valve and an outlet line out from the valve. There may also be other control cables lead into the valve within the housing. The housing may also comprise other valves and also control units and other equipment.

According to another aspect the remote fluid supply can be arranged above the surface of the water wherein the valve system is submerged. The fluid supply line will in this case run from this above surface remote fluid supply to the subsea valve system. In another embodiment the remote fluid supply may also be submerged but in a distance from the valve system and possibly at a similar or different water depth than the valve system.

According to a further aspect, the valve may be an electric-hydraulic valve.

In yet another aspect the housing may comprise at least one main valve and at least one pilot valve for operation of the at least one main valve, where the fluid supply line is connected to both the main and pilot valve. There may also be one common or two separate fluid supply lines to two main valves, where one in this case only need one outlet from one fluid supply line within the housing to establish a pressure within the housing closer to the pressure within the valve than the ambient pressure at the site of the valve system.

According to another aspect the housing may be arranged within an outer container, which outer container is kept with an inside pressure mainly equal to the present ambient pressure at the site of the valve system. In an other embodiment the valve system is connected to a submerged pump system, arranged within a submerged container.

According to another aspect the outlet of the fluid supply line, within the housing leads to a pressure compensating system arranged within the housing. This pressure compensating system may for instance be a bellow system, which by this pressure compensating system transfers the pressure of the fluid within the fluid supply line to a fluid within the housing, but without mixing the two fluids. By this one may still keep a operationally favorable fluid surrounding the valves, but at the same time pressurize this to a level similar to the pressure of the fluid at the inlet of the valve.

The present invention also regards a method for protecting a subsea valve system wherein a valve with an inlet and an outlet at least partly is positioned within a fluid tight housing. The method comprises the steps of connecting a fluid supply line to the inlet of the valve and to a remote fluid supply, providing an outlet in the fluid supply line within the housing, providing a supply fluid in the fluid supply line and thereby adding supply fluid to the inside of the housing and establish a fluid pressure within the housing mainly similar to the pressure of the supply fluid added through the fluid supply line to the inlet at the valve.

BRIEF DESCRIPTION OF THE DRAWINGS

The invention will now be explained with reference to a non-limiting embodiment, where.

DETAILED DESCRIPTION

Figure 1:
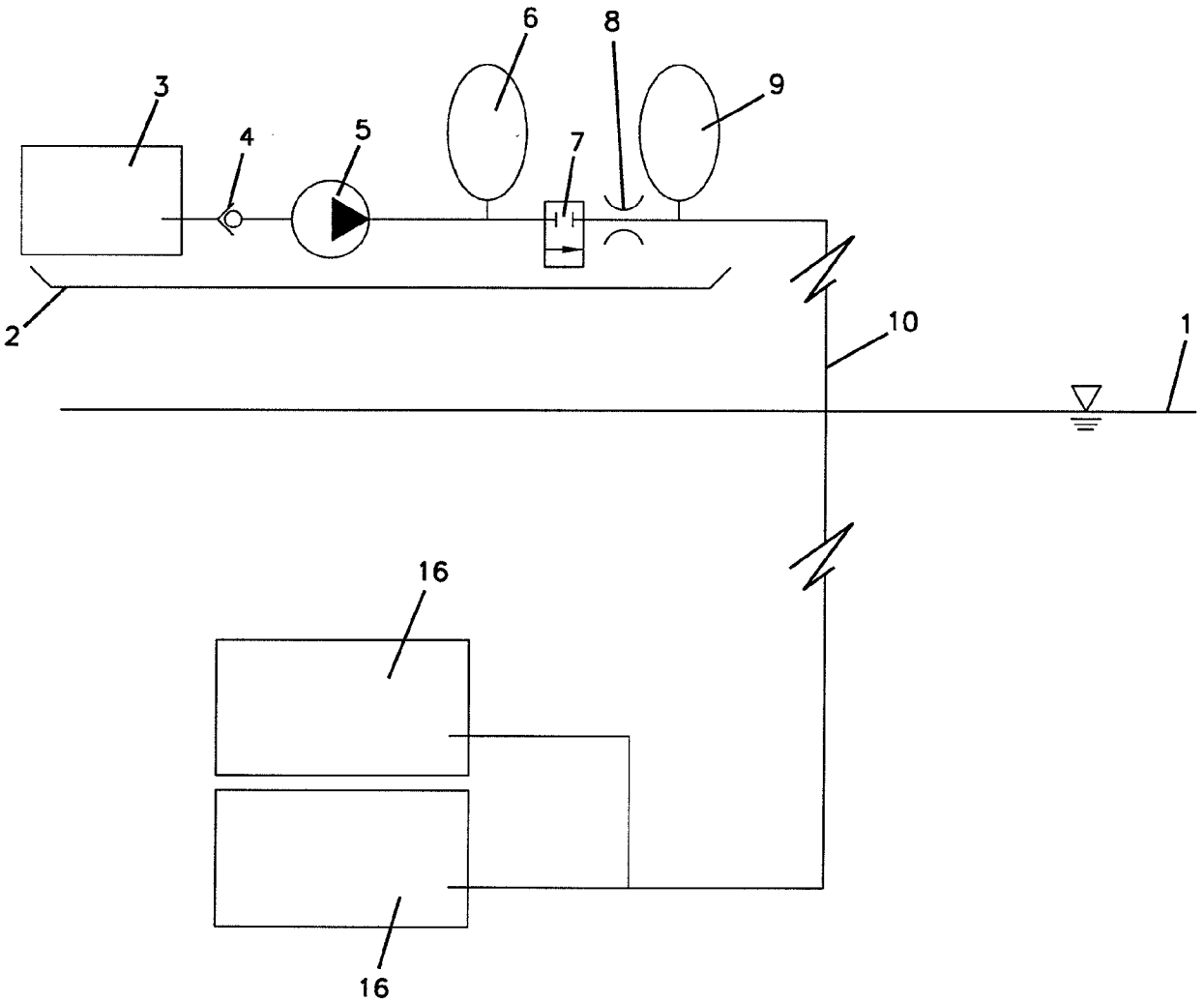
FIG. 1 is a principle sketch showing a possible use of the subsea valve system.

The present invention regards a subsea valve system which therefore is submerged under a sea surface 1, and in some cases positioned on the sea bed and in other cases positioned in a distance above the sea bed, for instance close to or form part of a subsea installation, as a wellhead, a process unit etc. The valve system is supplied with a supply fluid from a remote location, in FIG. 1 this is indicated as a structure 2 above the sea surface 1. On this structure 2 there is arranged a fluid tank 3 connected to the fluid supply line 10. there is in the fluid supply line 10 also arranged a one-way valve 4 and a pump 5 to increase the pressure of the fluid within the fluid supply line 10 to the level one wants to deliver the supply fluid to the valve system. To even out the pressure and limit pressure pulses in the fluid supply line there is also arranged a first accumulator 6 an orifice 8 and a second accumulator 9 around a control valve 7. The fluid supply line 10 may deliver supply fluid to one or more submerged containers 16.

Figure 2:
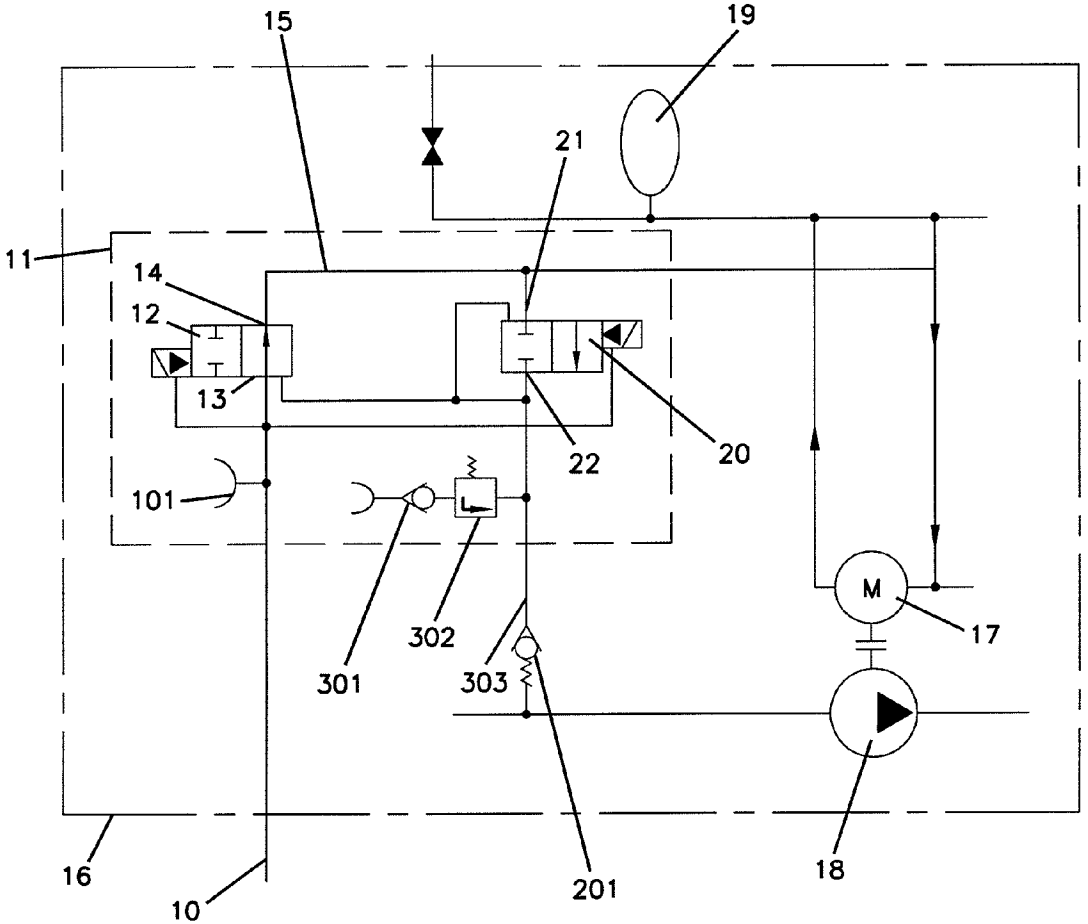
FIG. 2 shows a possible embodiment of a valve system according to the invention.

As shown in FIG. 2 there may within a submerged container 16 be arranged different equipment among other also the housing 11 which according to the invention is surrounding the first valve 12, whereto the fluid supply line 10 is connected at the inlet 13 of the first valve 12. The first valve 12 also comprises an outlet 14 leading into an outlet line 15. This outlet line is shown to lead out of the housing II and to a system with an accumulator 19, a motor 17 connected to a pump 18 etc. According to the invention there is within the housing II arranged an outlet 101 from the fluid supply line 10. The housing II will through this outlet 101 be filled with the fluid within the fluid supply line 10 and at a pressure similar to the pressure at the inlet 13 of the first valve 12. In the embodiment shown there is arranged a second valve 20 with and inlet 21 connected to the fluid supply line 10 and an outlet 22 connected to the outlet line 15.

When valve outlet 22 is closed and the ambient pressure increases inside the housing 11, a volume inside the line 301 between the outlet 22 and check valve 201 can be trapped at lower pressure. To prevent this, in the line between the valve outlet 22 and the check valve 201 to the process line a relief valve 302 is fitted, bleeding fluid into the line at a certain overpressure (typically 345 bar, given as a non-limiting example). The check valve 301 prevents flow from the line 303 to enter the housing 11.

The invention has now been explained with one embodiment, a skilled person will understand that there may be made several alterations and modifications to this system within the scope of the invention as defined in the attached claims. The outlet 101 arranged within the housing 11 may be arranged to lead into a bellow system (not shown) within the housing 11 for by this pressure compensate the internal fluid filled space of the housing 11 to the pressure of the fluid within the fluid supply line 10. The housing may be positioned directly in the water without the outer canister 16. There may be other equipment arranged within the housing. There may be only one valve arranged within one housing.

The invention claimed is:

1. Subsea valve system comprising a first valve, a fluid supply line connectable to a remote fluid supply and in connection with an inlet of the first valve, an outlet of the first valve connectable to an outlet fluid line and a fluid tight housing at least partly enclosing the valve, wherein the fluid supply line comprises an outlet within the fluid tight housing, thereby filling the fluid tight housing with supply fluid from the fluid supply line and at a pressure equal to the pressure of the supply fluid at the inlet of the first valve such that the pressure within the fluid tight housing and the pressure of the supply fluid are maintained equal.

2. Subsea valve system according to claim 1, wherein the fluid tight housing fully encloses the first valve.

3. Subsea valve system according to claim 1, wherein the remote fluid supply is arranged above a sea surface wherein the first valve system is submerged.

4. Subsea valve system according to claim 1, wherein the first valve is an electric-hydraulic valve.

5. Subsea valve system according to claim 1, wherein the fluid tight housing comprises at least one second valve, where the fluid supply line is connected to both the first valve and the second valve.

6. Subsea valve system according to claim 1, wherein the fluid tight housing is arranged within an outer container, which outer container is kept with an inside pressure equal to the present ambient pressure at a site of the subsea valve system.

7. Subsea valve system according to claim 1, wherein the valve system is connected to a submerged pump system.

8. Subsea valve system according to claim 1, wherein the outlet within the housing leads to a pressure compensating system arranged within the housing.

9. Method for protecting a subsea valve system wherein a first valve with an inlet and an outlet at least partly is positioned within a fluid tight housing, connecting a fluid supply line to the inlet of the first valve and to a remote fluid supply, wherein the method comprises:

providing an outlet in the fluid supply line within the fluid tight housing, providing the fluid supply in the fluid supply line, and providing the fluid supply through the outlet to the inside of the fluid tight housing at a pressure equal to the pressure of the fluid supply added through the fluid supply line at the inlet of the first valve such that the pressure within the fluid tight housing and the pressure of the fluid supply are maintained equal.

* * * * *

UNITED STATES PATENT AND TRADEMARK OFFICE

CERTIFICATE OF CORRECTION

PATENT NO. : 8,485,211 B2
APPLICATION NO. : 12/676595
DATED : July 16, 2013
INVENTOR(S) : Eide et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 473 days.

Signed and Sealed this
Eighth Day of September, 2015

Michelle K. Lee

Michelle K. Lee
*Director of the United States Patent and Trademark Office*